US008041061B2

(12) United States Patent
Hughes, II et al.

(10) Patent No.: US 8,041,061 B2
(45) Date of Patent: Oct. 18, 2011

(54) DIPOLE AND MONOPOLE SURROUND SOUND SPEAKER SYSTEM

(75) Inventors: Charles Emory Hughes, II, Milford, PA (US); Olin Daniel Williford, Milford, PA (US)

(73) Assignee: Altec Lansing, LLC, Milford, PA (US)

( * ) Notice: Subject to any disclaimer, the term of this patent is extended or adjusted under 35 U.S.C. 154(b) by 0 days.

(21) Appl. No.: 10/956,095

(22) Filed: Oct. 4, 2004

(65) Prior Publication Data

US 2006/0072773 A1 Apr. 6, 2006

(51) Int. Cl.
*H04R 5/02* (2006.01)

(52) U.S. Cl. ..... 381/304; 381/335

(58) Field of Classification Search ..... 381/300, 381/304, 310, 335–336, 332, 386, 160, 17, 381/28, 387; 181/145, 148, 155
See application file for complete search history.

(56) References Cited

U.S. PATENT DOCUMENTS

| | | | | |
|---|---|---|---|---|
| 4,578,809 | A | 3/1986 | Eberbach | 381/99 |
| 4,691,362 | A | 9/1987 | Eberbach | 381/99 |
| 4,723,289 | A * | 2/1988 | Schreiber et al. | 381/304 |
| 4,757,544 | A * | 7/1988 | Guy | 381/387 |
| 4,819,269 | A | 4/1989 | Klayman | 381/24 |
| 4,847,904 | A | 7/1989 | McShane | 381/24 |
| 4,888,804 | A | 12/1989 | Gefvert | 381/24 |
| 4,932,060 | A * | 6/1990 | Schreiber | 381/24 |
| 4,953,223 | A * | 8/1990 | Householder | 381/188 |
| 5,109,416 | A * | 4/1992 | Croft | 381/304 |
| 5,117,459 | A | 5/1992 | McShane | 381/24 |
| 5,301,237 | A | 4/1994 | Fosgate | 381/89 |
| 5,809,150 | A * | 9/1998 | Eberbach | 381/300 |
| 5,870,484 | A * | 2/1999 | Greenberger | 381/300 |
| 6,219,426 | B1 * | 4/2001 | Daniels et al. | 381/307 |
| 6,870,941 | B2 * | 3/2005 | Marnie | 381/337 |
| 2006/0050907 | A1 * | 3/2006 | Levitsky | 381/304 |

FOREIGN PATENT DOCUMENTS

JP 06-153290 * 5/1994

* cited by examiner

*Primary Examiner* — Xu Mei
*Assistant Examiner* — Lun-See Lao
(74) *Attorney, Agent, or Firm* — Greenberg Traurig LLP

(57) ABSTRACT

A speaker system utilizes dipole speaker drivers in conjunction with monopole speaker drivers in a listening area to disperse a surround sound effect to a listener. The dipole speaker drivers are physically mounted on top of the front left and right speakers and are angled in a way that the surround information is delivered to the listener via wall/room reflections. By reflecting the sound off the walls, the system provides a delayed diffuse audio signal from the dipole speakers, enhancing the surround effect.

20 Claims, 7 Drawing Sheets

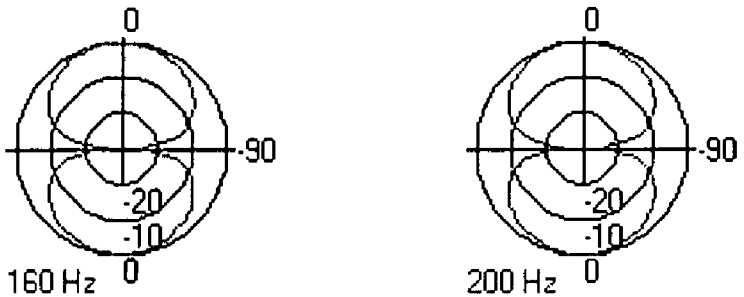
FIG. 4
FIG. 5
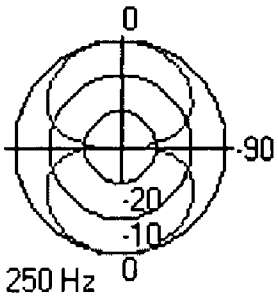
FIG. 6
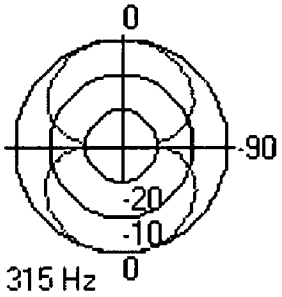
FIG. 7
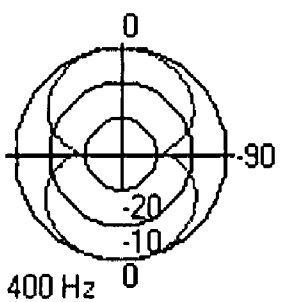
FIG. 8
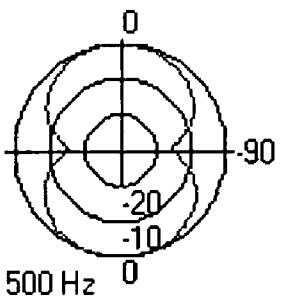
FIG. 9
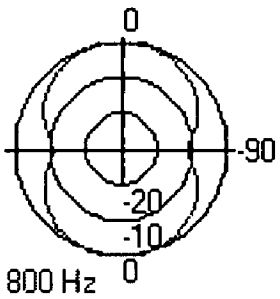
FIG. 10
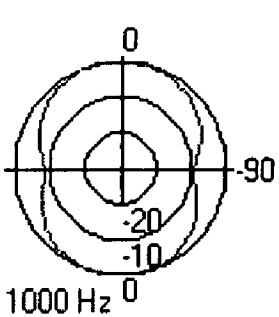
FIG. 11

DIPOLE AND MONOPOLE SURROUND SOUND SPEAKER SYSTEM

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

The present invention relates to the field of audio speakers used to provide sound from multiple directions to the listener.

BACKGROUND OF THE INVENTION

Audio systems often include at least two speakers positioned to the front left and right of a listener. In a conventional home theater setting, the two speakers are positioned to the left and right of a television screen. In a conventional desktop setting having a computer, the two speakers are positioned to the left and right of a computer screen. Optionally, bass units or subwoofers are added, which can deliver the lower frequency range and permit smaller speakers. The subwoofer can be placed at almost any location. An optional center speaker may be positioned directly in front of the listener, between the left and right speakers. A conventional audio system having left and right speakers and a subwoofer (known as a "2.1" configuration) and the optional center speaker (known as a "3.1" configuration) is compact, but does not provide surround sound to the listener.

One conventional approach to providing surround sound to the listener is to add rear speakers to the listening area, located behind or to the sides of the listener. The speakers form a circular, square or rectangular array with the listener at or near the center. A surround sound processor may incorporate positional encoding by means of specific phase differences and amplitude ratios to enhance the effect of spatially surrounding the listener. A five speaker arrangement with a subwoofer (known as a "5.1" configuration) provides a desired surround sound effect. It is desirable, however, to achieve a surround sound effect with a more compact configuration.

U.S. Pat. No. 5,109,416 to Croft discloses a dipole speaker for producing ambient sound in a multichannel sound reproduction system. Used in conjunction with direct path speakers connected to the audio system, the additional surround dipole speakers are placed in front of and behind the listener on the centerline of the listening setup. The radiation from the dipole speaker is such that one lobe of the sound pressure output is 180 degrees out of phase with the other so that they cancel each other out to produce a null zone aligned towards the listener. The sound pressure lobes are directed toward the walls so the acoustical signal of the dipole is reflected therefrom and arrives at the listener by an indirect path. The delayed indirect path of the signal from the dipole enhances the ambience of the effect of the dipole speaker. However, Croft does not achieve a compact design because a rear dipole speaker is required directly behind a listener. If the listener is using the Croft system with a computer on a desktop, the use of a rear dipole speaker may not be feasible.

One conventional system attempts to provide a system with a surround sound effect for use with a computer. U.S. Pat. No. 5,809,150 to Eberbach discloses a surround speaker system that utilizes skewed hypercardioid sound energy fields from right front and left front "surround" speakers with the principle nulls directed at the expected listener location. This produces the effect of side wall and rear wall speakers in a home theater setting without actual side wall or rear wall speakers. The effect is enhanced by secondary nulls that are directed so as to reflect off the front wall of the room toward the expected listener location. Each surround speaker contains an antiphase driver and circuitry that powers the drivers to create the skewed hypercardioid sound energy field. However, Eberbach's hypercardioid sound energy fields do not produce a sufficient dispersion of sound. With a very tight pattern, hypercardioid speakers do not provide a wide distribution across the horizontal plane. As a result, the surround sound effect is minimized.

Conventional surround sound systems generally require rear speakers for proper production of a surround sound effect. It would be desirable, therefore, to have a system which is capable of producing such surround sound effect without speakers positioned in the rear of the listening area.

SUMMARY OF THE INVENTION

Accordingly, the present invention is directed to a speaker system that substantially obviates one or more of the problems due to limitations and disadvantages of the related art. In particular, the present invention provides a surround sound effect without positioning speakers in the rear of the listening area. The conventional surround sound configuration having rear speakers is less desirable in a smaller listening area or where rear speakers cannot be properly positioned. It is desired to use a speaker configuration, e.g., a 2.1 or 3.1 configuration, that provides a 5.1 configuration surround sound effect without the use of rear speakers.

The present invention provides a surround sound effect to a home theater or other setting having speakers positioned only in front of the listener. The speaker arrangement can provide a 5.1 configuration surround sound effect with a 2.1 or 3.1 configuration in a reflective or reverberant space such as an office or living room. When the speaker system is used in conjunction with a center speaker and a subwoofer, the resultant 5.1 soundstage offers a more homogenous and cohesive effect when sounds are panned across the speakers as compared to a conventional 5.1 configuration where the sounds seem to appear in each speaker. The invention in its preferred embodiment provides a dipole/monopole combination in a speaker system which allows a more compact and user-friendly set up with fewer speaker units, less wiring, and less space required, while still providing a full 5.1 soundstage. This is useful in combination with a desktop or laptop computer as well as in a home theater that is placed in a normal listening space that has reflective surfaces.

The speaker system utilizes dipole speakers in conjunction with monopole speakers in a listening area to disperse a surround sound effect to a listener. In one embodiment, the dipole speakers are physically mounted on top of the front left and right speakers and are angled in a way that the surround information is delivered to the listener via wall/room reflections. The left and right information from the sealed enclosures are on a direct path to the listener's ears while the signals from the angled dipole speakers, which contain the surround information, are reflected off of the room boundary walls and eventually arrive at the listening position. This reflected signal path provides the time delay and diffusion that enhances the surround effect even though the sealed and dipole speakers are in a coincident position.

In one embodiment, a speaker system has one speaker unit to front left and one speaker unit to the front right of a listener. The speaker unit comprises a monopole driver directed at the listener's location and a dipole driver having an area of consistently lower output directed in the general vicinity of the listener. The speaker system may also comprise a center speaker or subwoofer. The dipole driver is located above the monopole driver in each speaker unit. The direction of the dipole driver is rotated from the direction of the monopole driver, wherein the degree of rotation is related to the location of the area of consistently lower output of the dipole driver. The left dipole driver is preferably rotated 45 to 75 degrees left from the direction of the left monopole driver direction, and the right dipole driver is preferably rotated 45 to 75 degrees right from the direction of the right monopole driver direction. In an alternative embodiment, the dipole driver is rotated 60 to 70 degrees from the direction of the monopole driver. In another alternative embodiment, the dipole driver is rotated 68 degrees from the direction of the monopole driver. The dipole driver has a straight baffle. Alternatively, the dipole driver has a wrapped baffle. The depth of the baffle is substantially equal to depth of the dipole driver.

In another embodiment, a method for providing a surround sound effect comprises the steps of providing a room for listening to the surround sound effect; positioning a left monopole speaker to the front left of a listener in the room, wherein the left monopole speaker provides a signal directed at the listener; positioning a right monopole speaker to the front right of a listener in the room, wherein the right monopole speaker provides a signal directed at the listener; positioning a left dipole speaker to the front left of a listener in the room, wherein the left dipole speaker provides a signal having an area of consistently lower output directed at the listener and the signal reflecting off a wall in the room; and positioning a right dipole speaker to the front right of a listener in the room, wherein the right dipole speaker provides a signal having an area of consistently lower output directed at the listener and the signal reflecting off a wall in the room. The left dipole speaker is directed at an angle of 45 degrees to 75 degrees to the left of the left monopole speaker. The right dipole speaker is directed at an angle of 45 degrees to 75 degrees to the right of the right monopole speaker. A center speaker is positioned between the right monopole speaker and the left monopole speaker, wherein the center speaker is directed at the listener. The left and right dipole speakers have a straight baffle.

In yet another embodiment, a system for providing a surround sound effect to a listening area comprises a front left speaker having a left monopole driver and a left dipole driver, the left monopole driver being directed at a listening area and the left dipole driver rotated to the left of the left monopole driver such that the area of consistently lower output of the left dipole driver is directed towards the listening area; and a front right speaker having a right monopole driver and a right dipole driver, the right monopole driver being directed at a listening area and the right dipole driver rotated to the right of the right monopole driver such that the area of consistently lower output of the right dipole driver is directed towards the listening area. The left and right dipole drivers have a wrapped baffle that extends substantially the length of the dipole driver. In one embodiment, the left and right dipole drivers have a straight baffle.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of at least one embodiment of the invention.

In the drawings:

FIGS. 4 to 20 are polar plots of various multiple one-third octave spans for a dipole speaker according to an embodiment of the present invention.

DETAILED DESCRIPTION OF THE PREFERRED EMBODIMENT

Reference will now be made in detail to the preferred embodiments of the present invention, examples of which are illustrated in the accompanying drawings.

The present invention provides a speaker system that allows for surround sound without the use of rear speakers. Although the exemplary embodiments do not discuss the use of the system in a particular setting, the system may be configured for use in a home, office, theater, vehicle, or other arena where a surround sound effect is desired. The system may be used for a home theater with a television or other means of viewing video. Similarly, the system may be used with a computer to achieve a surround sound effect at a desktop. A desktop application for the system may be two speakers, along with an optional subwoofer and center speaker. Alternatively, the system may be used to listen to audio, such as music, without a video feed.

Figure 1:
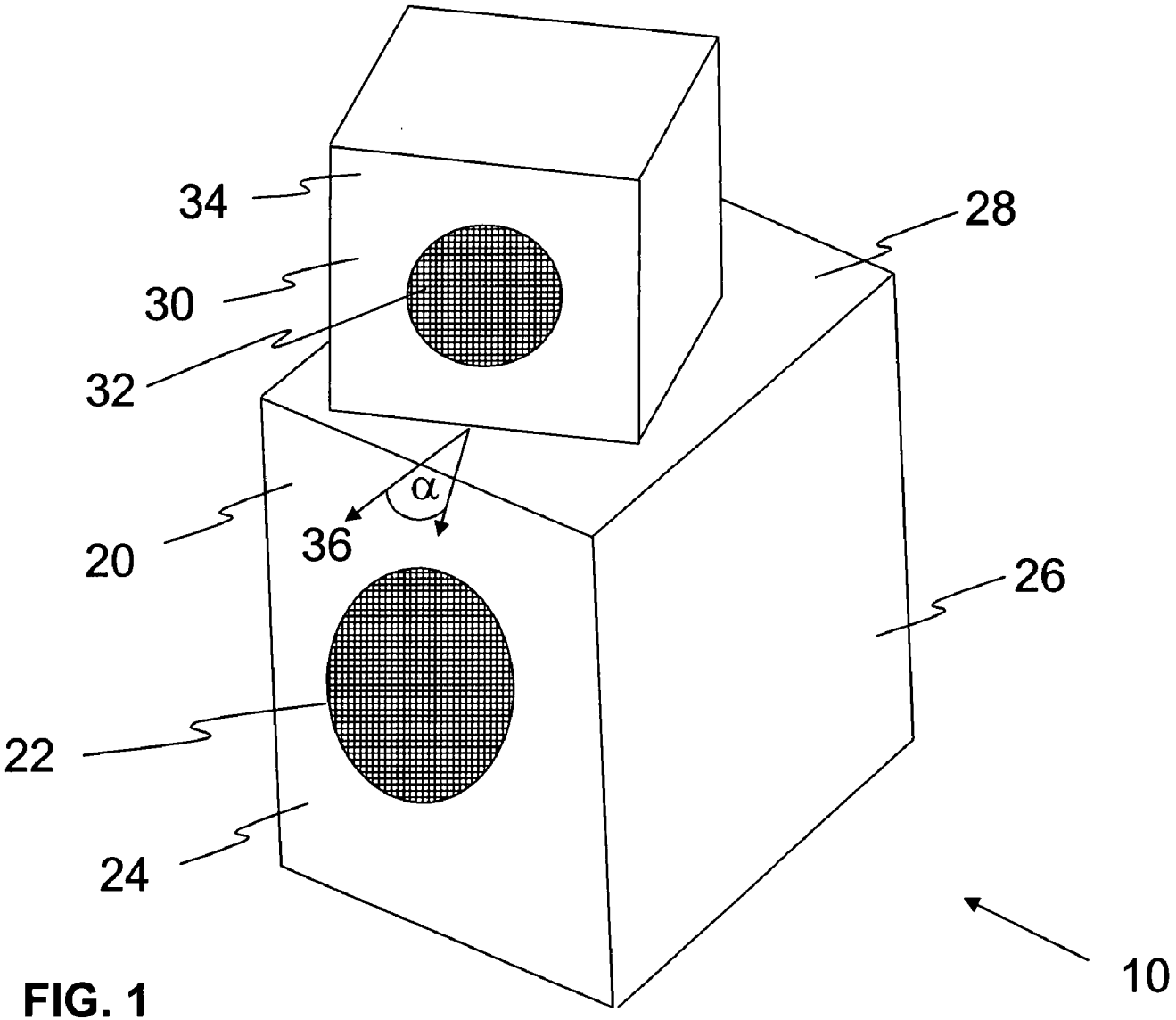
FIG. 1 is a speaker unit according to an embodiment of the present invention.

The speaker system has at least two speaker units, each speaker having a monopole speaker and a dipole speaker. Optionally, the system may also include a center speaker and/or a subwoofer. Referring to FIG. 1, an exemplary speaker unit 10 is shown. Speaker unit 10 is constructed of a monopole speaker 20 and a dipole speaker 30.

Monopole speaker 20 has at least one driver 22 installed on a single face 24 of a speaker cabinet 26. Cabinet 26 is directed towards a listener or listening area. Because cabinet 26 completely encloses driver 22, the sound is emitted in only one direction. In a surround sound system, the front left, front right, and center speakers are typically monopole speakers due to their directional sound. In the present embodiment, the front left, front right, and optional center speaker all have at least one monopole speaker.

In order to complete a 5.1 configuration for surround sound, dipole speaker 30 is positioned atop monopole speaker 20. In this exemplary embodiment, dipole speaker 30 is fixed to a top surface 28 of monopole speaker 20. However, dipole speaker 30 may be alternatively positioned to the side or below monopole speaker 20.

Dipole speaker 30 emits sound in opposite directions. With a wide dispersion of sound, dipole speaker 30 emits the sound in a controlled pattern, substantially covering the room with limited output in the direction of the listener. Dipole speaker 30 is able to create a more diffuse sound due to the structure of dipole speaker 30. Unlike monopole speaker 20, dipole speaker 30 is not completely enclosed in a cabinet.

Dipole speaker 30 has a driver 32 installed on a face 34. In this exemplary embodiment, the driver 32 is substantially wrapped. However, the rear of the driver remains exposed.

In a first embodiment, the dipole speaker has a straight baffle. As compared to straight and wrapped baffle designs of varying sizes the straight baffle has the highest attenuation of low frequencies with little affect on higher frequencies. In an alternative embodiment using a wrapped baffle, the low frequency response improves with a small baffle but there is no appreciable low frequency extension with an increase in baffle size. However, frequencies related to the size of the frontal surface area of the baffle may be affected at various levels as the frontal surface area of the baffle changes. As the frontal surface area of the wrapped baffle grows larger, the attenuation is less and moves slightly lower in frequency. There is no attenuation in this range without the baffle.

In a preferred embodiment, the dipole speaker has a wrapped baffle. The wrapped baffle substantially covers the sides of the driver. As the frontal area of the baffle increases, the attenuation of frequencies between 1 kHz and 3 kHz becomes slightly higher. Additionally, the increase in the low frequency response as compared to the straight baffle is limited. Preferably, the wrapped baffle is as deep as the driver itself. This configuration yields the flattest response between 1 kHz and 20 kHz and matches the low frequency response of speakers incorporating larger baffles.

Figure 2:
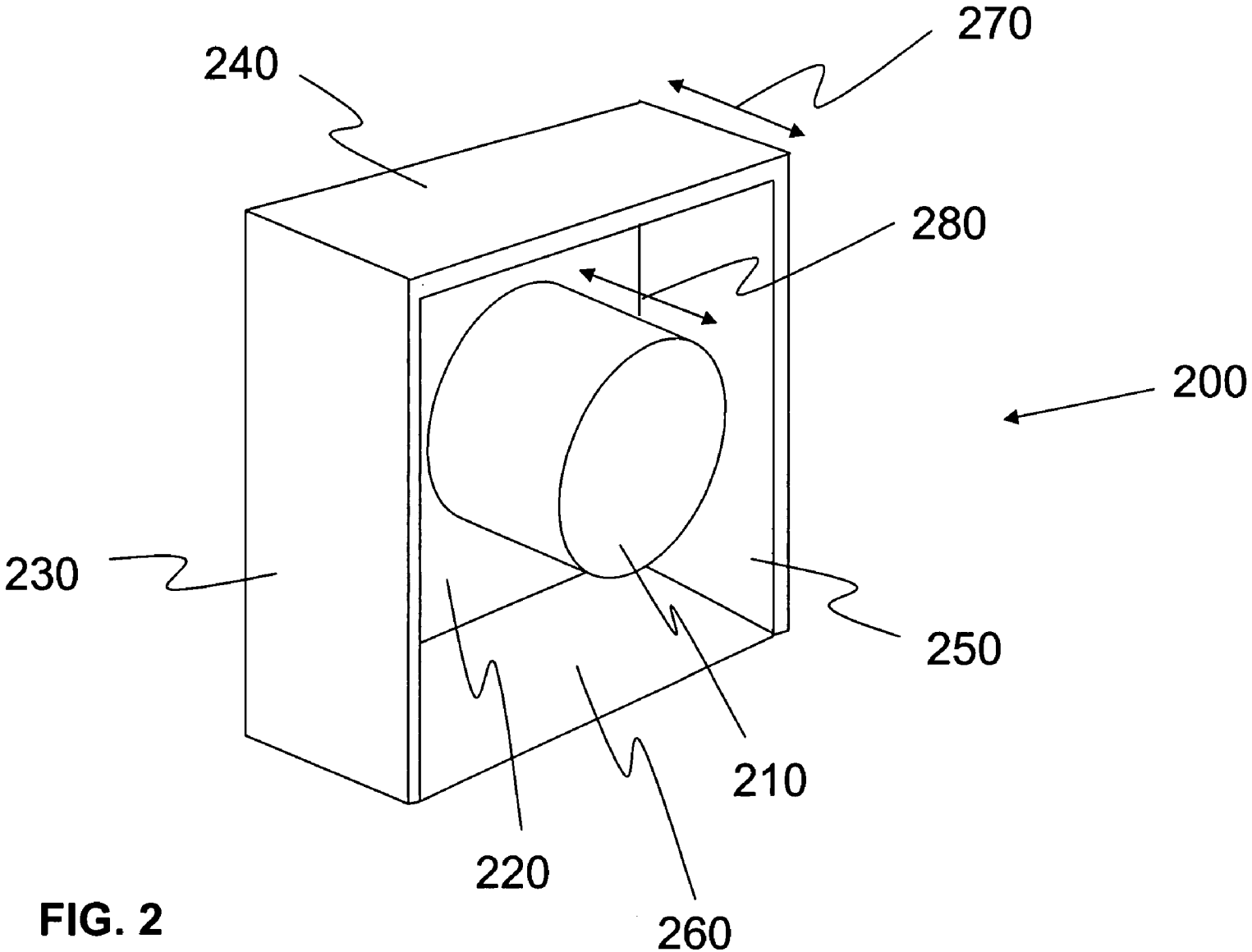
FIG. 2 is rear view of a dipole speaker according to an embodiment of the present invention.

Referring to FIG. 2, the rear side of a dipole speaker 200 is shown. A driver 210 is installed in a face 220 of dipole speaker 200 and housed within walls 230, 240, 250, 260. The rear of driver 210 remains exposed. In order to achieve desirable sound dispersion, walls 230, 240, 250, 260 extend a length 270 substantially equal to a length 280 representing the depth of driver 210. Also, wall 260 may be incorporated into the upper surface of a monopole speaker. The length of walls 230, 240, 250, 260 may be varied. Length 270 may be greater or less than length 280. In one embodiment of the present invention, driver 210 is in a wrapped baffle, having one wall in common with a monopole speaker. In yet another alternative embodiment, the rear of driver 210 is substantially covered by a screen, dust cover, or similar material known in the art that does not affect the sound emissions. Similarly, driver 210 may be substantially surrounded by side walls, exposing only the rear of driver 210 through the rear wall.

Dipole speaker 30 is positioned on top surface 28 of monopole speaker 20 at an angle $\alpha$. Monopole speaker 20 is directed towards a listener or listening area and dipole speaker 30 is rotated at an angle $\alpha$ from a direction 36 of monopole speaker 20. Angle $\alpha$ corresponds to an area of consistently lower output for dipole driver 32 and may vary depending on the driver and baffle configuration used in dipole speaker 30.

The area of consistently lower output is generally the direction of radiation with decreased, but similar in level, audio output compared to the level on-axis over a range of frequencies. FIGS. 4 through 20 depict a series of polar plots of sound pressure level that illustrate a range of angles of consistently lower output for a dipole speaker between 45 degrees and 75 degrees. The concentric rings illustrate 10 dB intervals of pressure differential. The reference numbers to frequency in Hz refer to center frequencies for lower and upper octave bands that bound the frequency range of the test result. The polar plots range in frequency from 160 Hz to 8000 Hz and the angle of consistently lower output remains between 45 and 75 degrees.

The dipole speaker position is fixed such that an area of consistently lower output is directed in the general vicinity of the listener. In this embodiment, an angle of consistently lower output is between 45 and 75 degrees so angle $\alpha$ is between 45 and 75 degrees. In an exemplary embodiment, this angle is at 68 degrees. As a result, angle $\alpha$ is a rotation of 68 degrees from the monopole speaker position.

Figure 3:
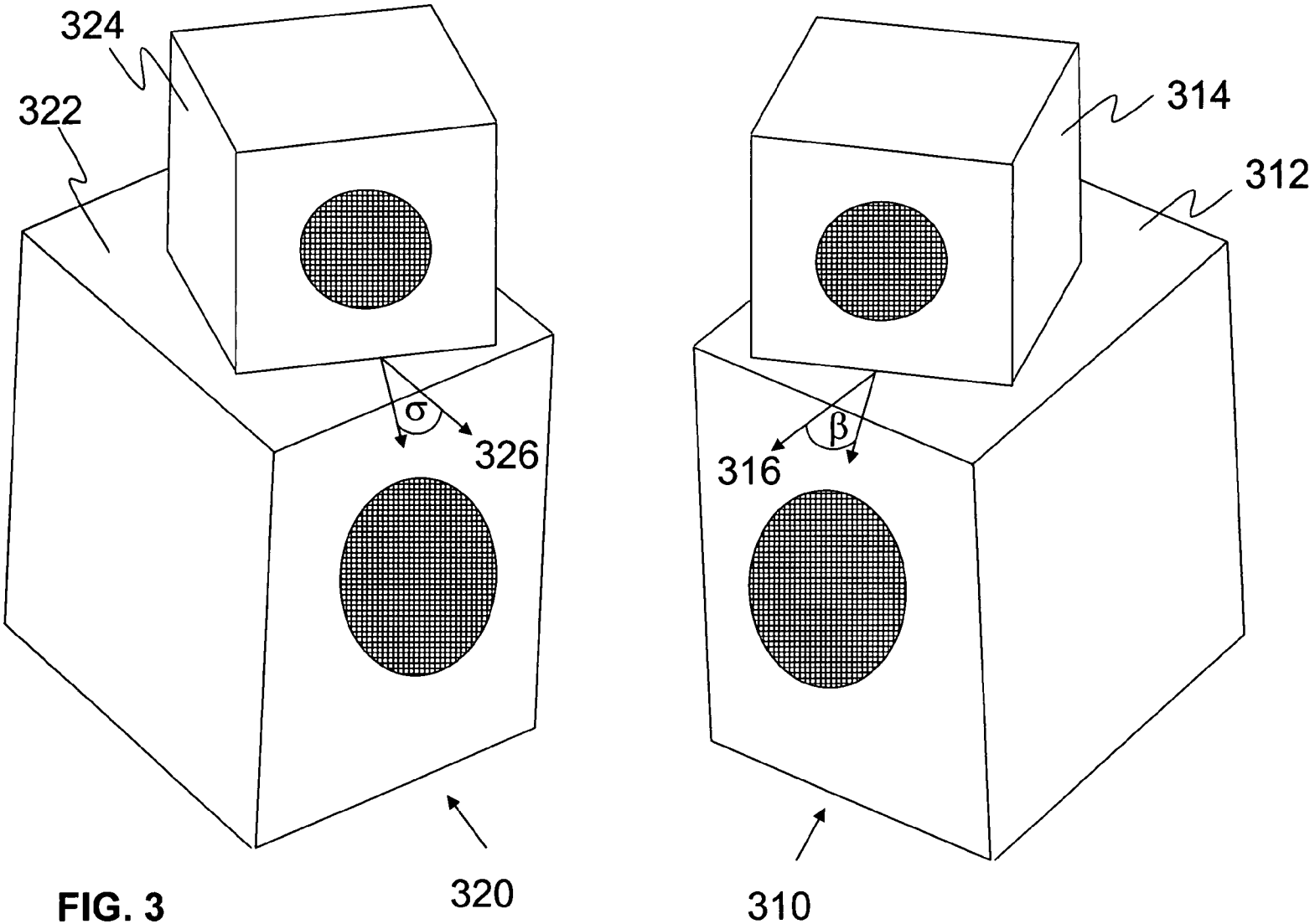
FIG. 3 shows left and right speaker units according to an embodiment of the present invention.
Figure 12:
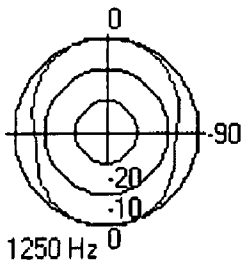
Figure 13:
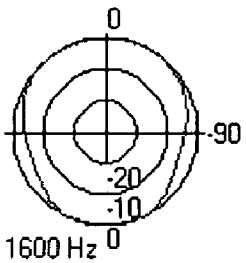
Figure 14:
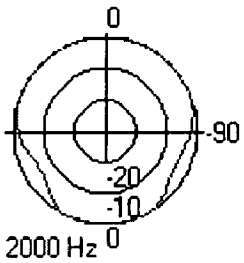
Figure 15:
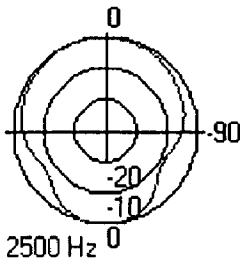
Figure 16:
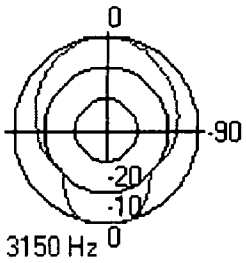
Figure 17:
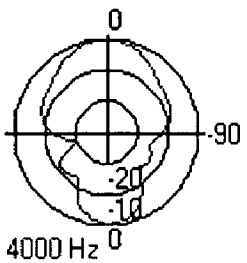
Figure 18:
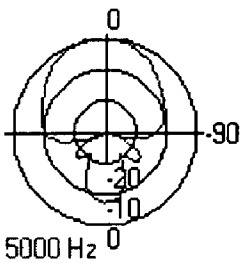
Figure 19:
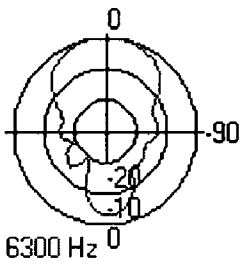
Figure 20:
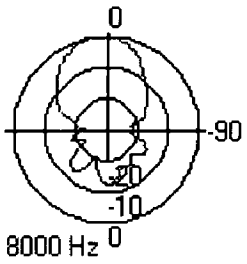

Both the left and right speaker units have a monopole speaker and a dipole speaker. In order to optimize the diffused sound emanating from the dipole speakers, the dipole speakers are rotated in different directions on the left and right speaker units. Referring to FIG. 3, a right speaker unit 310 and a left speaker unit 320 are shown. Right speaker unit 310 has a monopole speaker 312 and a dipole speaker 314. Left speaker unit 320 has a monopole speaker 322 and a dipole speaker 324.

On right monopole speaker 312, dipole speaker 314 is rotated left an angle $\beta$ from a direction 316 of monopole speaker 312. Conversely, on left monopole speaker 322, dipole speaker 324 is rotated right an angle $\sigma$ from a direction 326 of monopole speaker 322.

Figure 21:
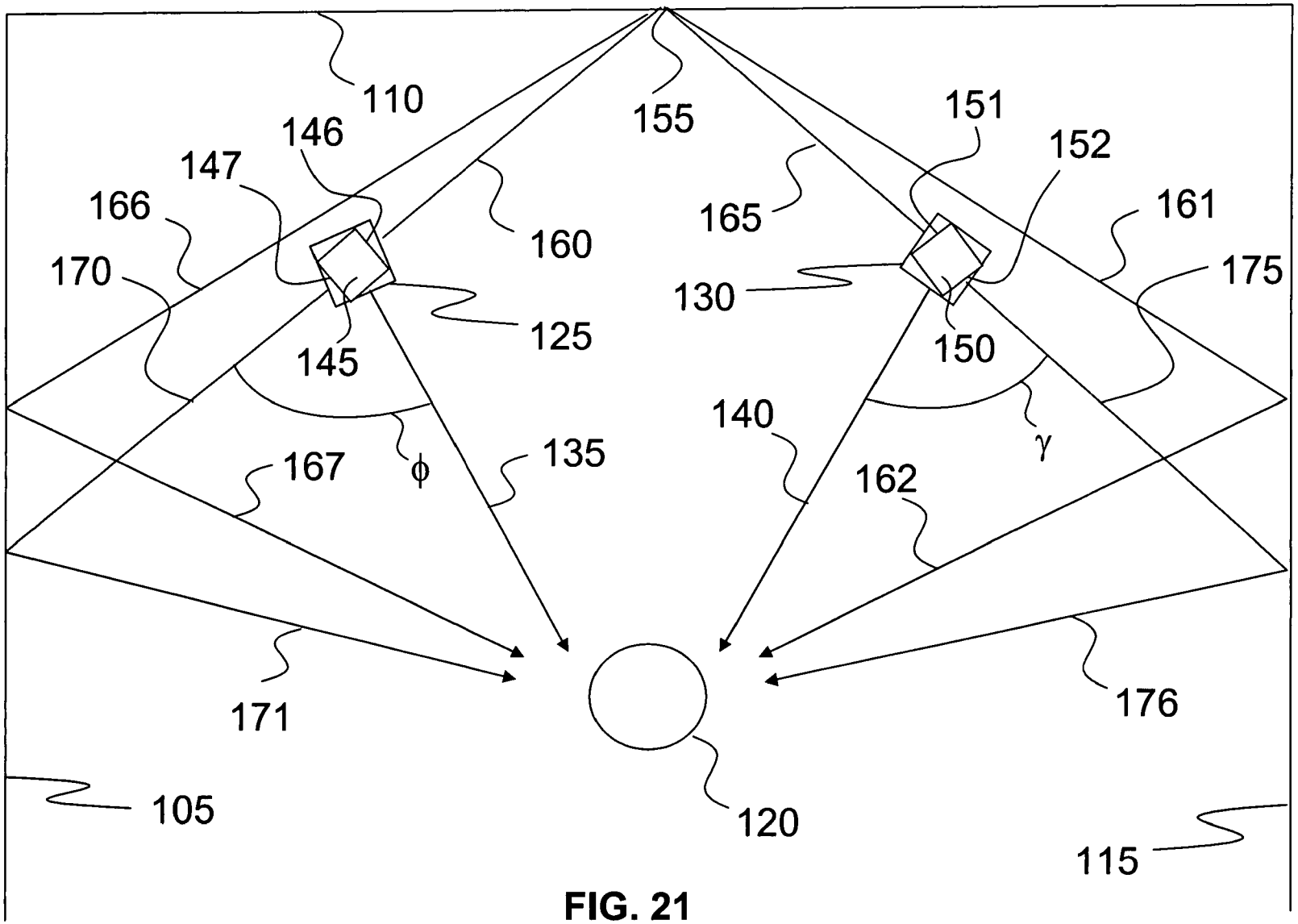
FIG. 21 illustrates the direction of sound energy toward a listener according to an embodiment of the present invention.

Referring now to FIG. 21, a listener 120 in a room utilizing the system of an embodiment of the present invention is shown. The room is shown with three walls 105, 110, 115 in a rectangular shape. However, walls 105, 110, 115 may be configured in a non-rectangular shape. A listener 120 is positioned substantially centered between wall 105 and wall 115. Although referred to in the singular, listener 120 represents at least one person that is subjected to the surround sound effect according to the embodiment. For example, listener 120 may represent a person listening in a room of a house, a person sitting at desk having a computer, many people listening in a movie theater, or at least one passenger in an automobile. Additionally, listener 120 does not need to be positioned in the center of the room. Listener 120 may be located at any position in the room facing the speaker system of the present invention. The surround sound experience may even be enhanced if listener 120 is not centered, the speaker system of the present invention is not centered, or the room is not substantially symmetrical.

Listener 120 faces the speaker system of the present invention. The speaker system has a left monopole speaker 125 and a right monopole speaker 130 positioned to face listener 120. The front face of monopole speaker 125, 130 is directed substantially to listener 120 in a direction 135, 140. Due to the highly directional nature of a monopole speaker, sound emanates from monopole speakers 125, 130 to listener 120 in direction 135, 140.

An optional center speaker, not shown, may be positioned between monopole speakers 125, 130. This optional center speaker may also be a monopole speaker. An optional subwoofer, not shown, may be positioned at substantially any location in the listening area.

A pair of dipole speakers 145, 150 are positioned atop monopole speakers 125, 130. Dipole speakers 145, 150 are rotated an angle $\phi$, $\gamma$ from direction 135, 140. Angle $\phi$, $\gamma$ corresponds to the area of consistently lower output of dipole speakers 145, 150. In order to direct the area of consistently lower output towards listener 120, dipole speakers 145, 150 are rotated by angle $\phi$, $\gamma$. Left dipole speaker 145 is rotated by angle $\phi$ to the left and right dipole speaker 150 is rotated by angle γ to the right. Alternatively, these angles need not be equivalent to accommodate for the properties of the room or the speakers.

Dipole speakers 145, 150 emit sounds that reflect off walls of the room before reaching listener 120. Because the sound reflects off the walls as opposed to the highly directed monopole speaker sounds, the reflected dipole speaker sounds arrive at listener 120 shortly after the monopole speaker sounds. The delay caused by the reflections enhances the surround sound effect. Rather than utilizing conventional rear speakers having a signal delay, the present invention has speakers positioned in front of the listener and takes advantage of the delay caused by reflected soundwaves.

The rotation of dipole speakers 145, 150 allows the sounds to be emitted in two directions, such that each direction reflects off a different wall. Each dipole speakers 145, 150 has a driver installed on a front side 147, 152 and the back of the driver is exposed on a rear side 146, 151. Both the straight baffle and wrapped baffle design of the speakers allows for sound to be emitted in both the front and rear directions.

The front sides 147, 152 of dipole speakers 145, 150 emit sound in a first direction. Dipole speaker 145 emits sound in a direction 170 to wall 105, which reflects the sound in a direction 171 to the left side of listener 120. Dipole speaker 150 emits sound in a direction 175 to wall 115, which reflects the sound in a direction 176 to the right side of listener 120.

Dipole speaker 145, located to the front left of listener 120, also emits sound in a reverse direction on side 146 in the direction 160 to location 155 on wall 110. The sound reflects in a direction 161 to wall 115. The sound reflects from wall 115 in a direction 162 to the right side of listener 120. Similarly, dipole speaker 150, located to the front right of listener 120, emits sound from the driver on side 151 in the direction 165 to location 155 on wall 105. The sound reflects in a direction 166 to wall 105. The sound reflects from wall 105 in a direction 167 to the left side of listener 120.

Sound from the drivers in direction 160, 165 does not need to be aimed directly at location 155, but may be preferable in a symmetrical listening area where listener 120 is positioned at a center point between walls 105, 115. In a non-symmetrical setup, the delay of the reflected sounds may reach listener 120 at different times. However, this delay usually less than one second may serve to enhance the surround sound effect.

In operation, a user positions the speakers around the listening area to obtain a surround sound effect. A left speaker unit is positioned to the front left of the listener. A right speaker unit is positioned to the front right of the listener. An optional center speaker is positioned substantially directly in front of the listener. An optional subwoofer is positioned anywhere in the room.

Figure 22:
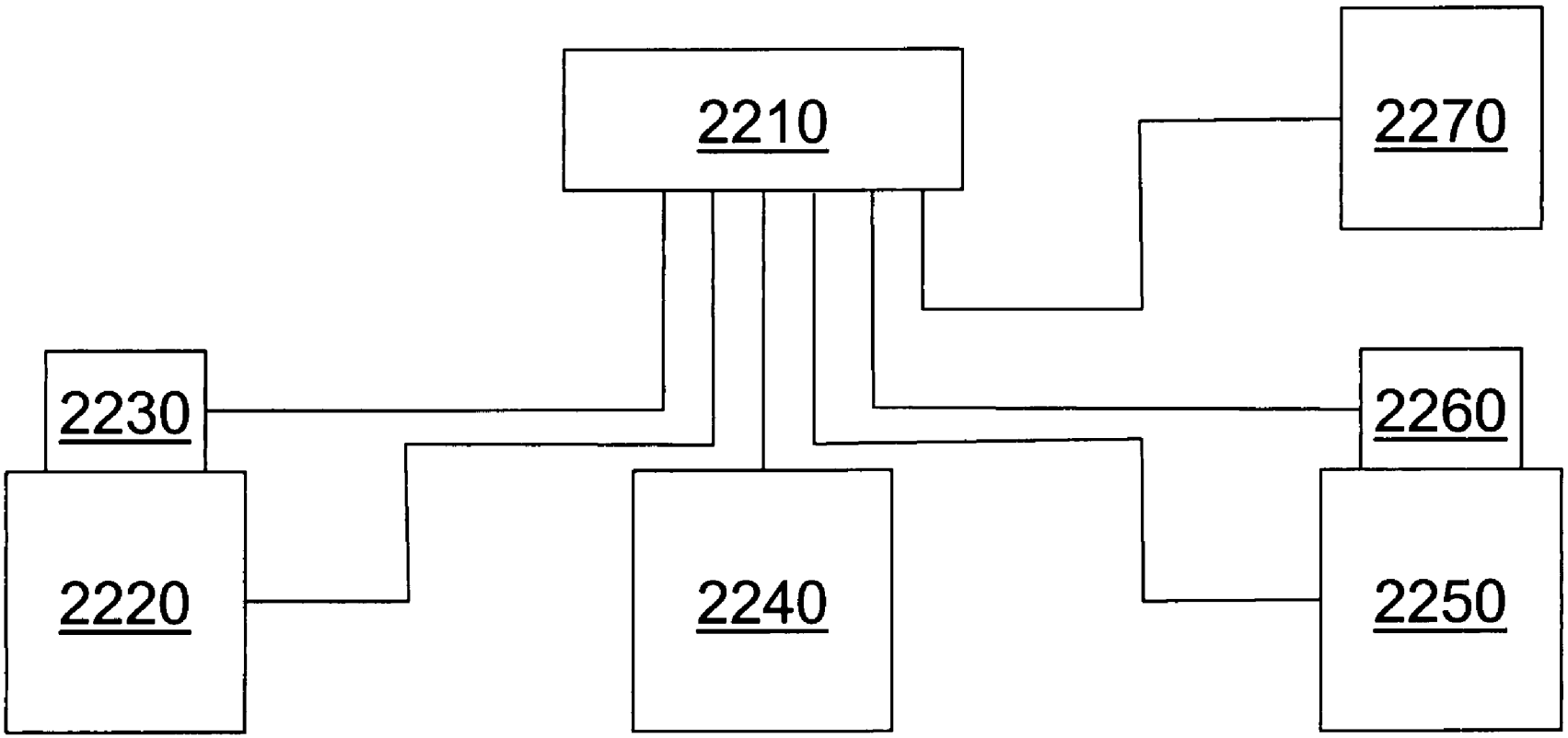
FIG. 22 is a schematic diagram of the speaker system according to an embodiment of the present invention.

A 5.1 configuration sound source may be used to provide a surround sound effect. Referring to FIG. 22, a schematic diagram of the signal distribution is shown. A sound source 2210 supplies signals to the speakers. A separate signal is provided to each of a front left monopole speaker 2220, front left dipole speaker 2230, center speaker 2240, front right monopole speaker 2250, front right dipole speaker 2260, and subwoofer 2270. This signal distribution allows for a 5.1 configuration with only three speaker units and a subwoofer. Alternatively, a sound source that produces fewer signals may be utilized. For example, the sound source provides only left and right audio signals which are distributed to the appropriate speakers.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A speaker system having one speaker unit for use at the front left of a listener location and one speaker unit for use at the front right of the listener location, comprising:

a right speaker unit having a right monopole driver directed at the listener location and a right dipole driver that consists of a single driver directed in a direction other than toward the listener location, said right dipole driver having a front output and a rear output directed in opposite directions toward at least two walls and reflected toward the listener location, said right dipole driver having an area of consistently lower output directed at the listener location; and, a left speaker unit having a left monopole driver directed at the listener location and a left dipole driver directed in a direction other than toward the listener location, said left dipole driver having a front output and a rear output directed in opposite directions toward at least two walls and reflected toward the listener location, said left dipole driver having an area of consistently lower output directed at the listener location, wherein said right dipole driver and said left dipole driver each consist of a single driver, the rear of said single driver being at least partially exposed, wherein a first enclosure surrounds at least four sides of said right monopole driver, including a side to the rear of said right monopole driver, and a second enclosure surrounds at least four sides of said left monopole driver, including a side to the rear of said left monopole driver.

2. The speaker system of claim 1, further comprising a center speaker.

3. The speaker system of claim 1, further comprising a subwoofer.

4. The speaker system of claim 1, wherein the left and right dipole drivers are located above the left and right monopole drivers, respectively.

5. The speaker system of claim 1, wherein:

the direction of the left dipole driver is rotated with respect to the direction of the left monopole driver by a degree of rotation corresponding to the location of the area of consistently lower output of the left dipole driver; and, the direction of the right dipole driver is rotated with respect to the direction of the right monopole driver by a degree of rotation corresponding to the location of the area of consistently lower output of the right dipole driver.

6. The speaker system of claim 5, wherein the direction of the left dipole driver is rotated 45 to 75 degrees left from the direction of the left monopole driver, and the direction of the right dipole driver is rotated 45 to 75 degrees right from the direction of the right monopole driver.

7. The speaker system of claim 6, wherein the direction of the left dipole driver is rotated 60 to 70 degrees left from the direction of the left monopole driver, and the direction of the right dipole driver is rotated 60 to 70 degrees right from the direction of the right monopole driver.

8. The speaker system of claim 7, wherein the direction of the direction of the left dipole driver is rotated 68 degrees left from the direction of the left monopole driver, and the direction of the right dipole driver is rotated 68 degrees right from the direction of the right monopole driver.

9. The speaker system of claim 1, wherein each dipole driver comprises a straight baffle.

10. The speaker system of claim 1, wherein each dipole driver comprises a wrapped baffle.

11. The speaker system of claim 10, wherein the depth of each baffle is substantially equal to depth of the respective dipole driver.

12. A method for providing a surround sound effect, the method comprising the steps of:

positioning a left monopole speaker to the front left of a listener location in a room, wherein the left monopole speaker provides a first signal directed at the listener location;

positioning a right monopole speaker to the front right of the listener location in the room, wherein the right monopole speaker provides a second signal directed at the listener location;

positioning a left dipole speaker that consists of a single driver to the front left of the listener location in the room, wherein the left dipole speaker provides a third signal having an area of consistently lower output directed at the listener location;

directing the left dipole speaker in a direction other than toward the listener location, wherein the left dipole speaker provides a front output and a rear output directed in opposite directions toward at least two walls and reflected toward the listener location;

positioning a right dipole speaker that consists of a single driver to the front right of a listener location in the room, wherein the right dipole speaker provides a fourth signal having an area of consistently lower output directed at the listener location; and directing the right dipole speaker in a direction other than toward the listener location, wherein the right dipole speaker provides a front output and a rear output directed in opposite directions toward at least two walls and reflected toward the listener location, wherein said right dipole speaker and said left dipole speaker each consist of a single driver, the rear of said single driver being at least partially exposed, wherein a first enclosure surrounds at least four sides of said right monopole speaker, including a rear side of said right monopole speaker, and a second enclosure surrounds at least four sides of said left monopole speaker, including a rear side of said left monopole speaker.

13. The method of claim 12, further comprising the step of directing the left dipole speaker at an angle of 45 degrees to 75 degrees to the left of the left monopole speaker.

14. The method of claim 12, further comprising the step of directing the right dipole speaker at an angle of 45 degrees to 75 degrees to the right of the right monopole speaker.

15. The method of claim 12, further comprising the step of positioning a center speaker between the right monopole speaker and the left monopole speaker, wherein the center speaker is directed at the listener location.

16. The method of claim 12, wherein the left and right dipole speakers comprise a straight baffle.

17. A system for providing a surround sound effect to a listening area, the system comprising:

a front left speaker having a left monopole driver and a left dipole driver that consists of a single driver, the left monopole driver being directed at the listening area and the left dipole driver rotated to the left of the left monopole driver such that the left dipole driver is directed in a direction other than toward the listener location, a front output and a rear output of the left dipole driver are directed in opposite directions toward at least two walls and reflected toward the listener location, and an area of consistently lower output of the left dipole driver is directed towards the listening area; and a front right speaker having a right monopole driver and a right dipole driver that consists of a single driver, the right monopole driver being directed at a listening area and the right dipole driver rotated to the right of the right monopole driver such that the right dipole driver is directed in a direction other than toward the listener location, a front output and a rear output of the right dipole driver are directed in opposite directions toward at least two walls and reflected toward the listener location, and an area of consistently lower output of the right dipole driver is directed towards the listening area, wherein said right dipole driver and said left dipole driver each consist of a single driver, the rear of said single driver being at least partially exposed, wherein a first enclosure surrounds at least four sides of said right monopole driver, including a side to the rear of said right monopole driver, and a second enclosure surrounds at least four sides of said left monopole driver, including a side to the rear of said left monopole driver.

18. The system of claim 17, wherein the left and right dipole drivers each comprise a wrapped baffle.

19. The system of claim 18, wherein each wrapped baffle extends substantially the length of the dipole driver.

20. The system of claim 17, wherein the left and right dipole drivers each comprise a straight baffle.

* * * * *